US006784370B1

(12) United States Patent
Keswani et al.

(10) Patent No.: US 6,784,370 B1
(45) Date of Patent: Aug. 31, 2004

(54) TWIST-ON WIRE CONNECTOR

(75) Inventors: Sushil N. Keswani, Sycamore, IL (US); Benjamin D. Swedberg, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 10/624,110

(22) Filed: Jul. 21, 2003

(51) Int. Cl.[7] ..... H01R 13/33
(52) U.S. Cl. ..... 174/87; 174/129 R; 439/415
(58) Field of Search ..... 174/87, 129 R, 174/133 R; 267/180; 439/415, 840

(56) References Cited

U.S. PATENT DOCUMENTS

| | | | | |
|---|---|---|---|---|
| 973,014 | A | * 10/1910 | Doolittle | 242/378.2 |
| 1,857,764 | A | * 5/1932 | Nygard | 267/166 |
| 2,086,321 | A | 7/1937 | Kudo | |
| 2,436,832 | A | * 3/1948 | Soreny | 439/841 |
| 2,521,670 | A | * 9/1950 | Starkey et al. | 192/41 S |
| 2,825,750 | A | 3/1958 | Stockwell | |
| 3,519,707 | A | 7/1970 | Krup | |
| 3,614,296 | A | 10/1971 | Blomstrand | |
| 3,727,902 | A | 4/1973 | Burckhardt et al. | |
| 4,110,418 | A | * 8/1978 | Martin | 261/98 |
| 4,112,251 | A | 9/1978 | Scott | |
| 4,220,811 | A | 9/1980 | Scott | |
| 4,303,733 | A | * 12/1981 | Bulle et al. | 428/367 |
| 4,451,695 | A | 5/1984 | Fink | |
| 4,531,016 | A | 7/1985 | Duve | |
| 4,707,567 | A | 11/1987 | Blaha | |
| 4,923,183 | A | 5/1990 | Saka | |
| 4,953,835 | A | 9/1990 | Matsumoto et al. | |
| 4,954,095 | A | * 9/1990 | Cogan | 439/284 |
| 4,985,991 | A | 1/1991 | Finn | |
| 5,259,599 | A | 11/1993 | Hernandez | |
| 5,260,515 | A | 11/1993 | Braun, Jr. | |
| 5,397,858 | A | 3/1995 | Delalle | |
| 5,461,198 | A | 10/1995 | Delalle | |
| 5,542,682 | A | 8/1996 | Goldstein et al. | |
| 5,642,875 | A | 7/1997 | Albers et al. | |
| 5,934,572 | A | 8/1999 | Hofmann et al. | |

FOREIGN PATENT DOCUMENTS

| | | |
|---|---|---|
| JP | 63-199936 | * 8/1988 |

* cited by examiner

*Primary Examiner*—Chau N. Nguyen
(74) *Attorney, Agent, or Firm*—Cook, Alex, McFarron, Manzo, Cummings & Mehler, Ltd.

(57) ABSTRACT

The present invention discloses novel twist-on wire connectors. These connectors include spring inserts having cross-sectional shapes which reduce the amount of material necessary to manufacture the spring insert without compromising the holding or gripping ability of the wire connectors. The cross-sectional shapes eliminate excess material in the spring insert that plays no part in holding and gripping the electrical wires that are to be joined and held together.

14 Claims, 2 Drawing Sheets

TWIST-ON WIRE CONNECTOR

BACKGROUND OF THE INVENTION

This invention is directed to wire connectors and more specifically to so-called screw-on or twist-on wire connectors which are more economical to produce.

Twist-on wire connectors are widely used in the electrical trades for joining electrical wires. Twist-on connectors are adapted to be screwed down on the stripped ends of electrical wires. These types of connectors typically have a shell or cap made of an insulating material, such as plastic. The shell is shaped for easy manipulation. For example, the exterior surface of the shell may have raised ribs, protrusions or wings to facilitate gripping and/or turning. The exterior surface may also include features to reduce slippage when twisting the connectors on by hand. The exterior may further be adapted to accommodate the use of hand tools, such as wrenches and pliers, or tool chucks so that power tools could be used to perform the installation.

The interior surface of the shell typically has a generally conically-shaped bore or cavity with a larger opening at the point of entry of the stripped electrical wires. The cavity tapers towards a closed end. Seated within the shell's cavity is a coiled metal wire commonly referred to as a spring. The outer contour of the spring usually matches the conically-shaped interior surface of the shell. Thus, the spring has a larger opening at the electrical wire receiving end and a smaller opening adjacent the closed end portion of the shell. The spring also defines an internal cavity which receives the electrical wires therein. Examples of prior art twist-on wire connectors are shown in U.S. Pat. Nos. 4,220,811, 4,227,040 and 4,691,079, the disclosures of which are incorporated herein by reference.

The spring facilitates the holding or gripping of the stripped ends of electrical wires in order to maintain contact between the electrical wires. The spring also grips the interior surface of the shell to prevent it from becoming detached and leaving the bare electrical wires exposed.

The cross-sectional shape of the wire used to form the spring is important to providing secure engagement with the stripped electrical wire ends and the interior surface of the shell. Presently, the most common cross-sectional shape is square or rectangular. The spring is oriented in the shell so that one comer or crest of this cross-sectional shape extends toward the inner surface of the shell. When the spring is inserted into the shell during manufacture of the connector the crest will grip the inner surface of the shell securely, thereby locking the spring and shell together. The opposite corner or crest of the spring wire's cross-sectional shape faces the cavity of the spring, positioning this crest for engagement with an electrical wire inserted into the connector. In this manner, each winding or coil of the spring presents a crest which can bite into the stripped ends of the wires in order to provide adequate fixation of the connector to the electrical wires.

Such wire connectors and the metallic spring inserts have not changed much over the years. The changes that have occurred focused on trying to improve the holding ability of the spring such as by changing the shape of the spring from a conical helix to an hourglass shaped helix or by increasing the number of engaging edges of the spring. However, these changes usually resulted in increasing the cost of manufacturing the wire connector. Therefore, there is a need for a twist-on wire connector that is more economical to produce without jeopardizing its gripping and holding ability.

The most expensive component of twist-on wire connectors is the metallic spring insert. One way to decrease the cost of the wire connector would be to reduce the amount of material used to make the spring. The reduction can be accomplished by decreasing the size of the spring or reducing the number of windings or coils of the helical spring. The spring could also be made thinner. However, all these approaches would also degrade the ability of the connector to grip and stay attached to the wires since less engagement surface will be available. Therefore, with this invention, it has been determined that the overall cost of a twist-on wire connector can be reduced by changing the cross-sectional shape of the wire used to make the spring to eliminate material not necessary to the proper functioning of the wire connector.

SUMMARY OF THE INVENTION

A twist-on wire connector includes an insulating cap having a body wall and an end wall. The body wall is typically conical and has an inner surface defining a generally conically-shaped internal cavity. There is an opening at one end of the shell cavity. A spring is mounted within the shell cavity and is fixedly attached to the inner surface of the body wall. The spring has a plurality of coils which in one embodiment have a hexagonal shaped cross-section. The lateral surfaces of the hexagonal shape may be planar or concave. In an alternate cross-sectional shape of the spring coils, there is an internal bore or void in the coils.

It has been determined that by changing the cross-sectional shape of the wire used to make the spring as described, an economically significant reduction in the amount of material used to make the spring can be realized without any loss of gripping and holding capacity. Holding and gripping is not compromised because the new cross-sectional shape eliminates portions of the old cross-sectional shape which have an insignificant effect on the gripping and holding ability of the spring with respect to both the stripped electrical wires and the interior surface of the shell.

DETAILED DESCRIPTION OF THE INVENTION

Figure 1:
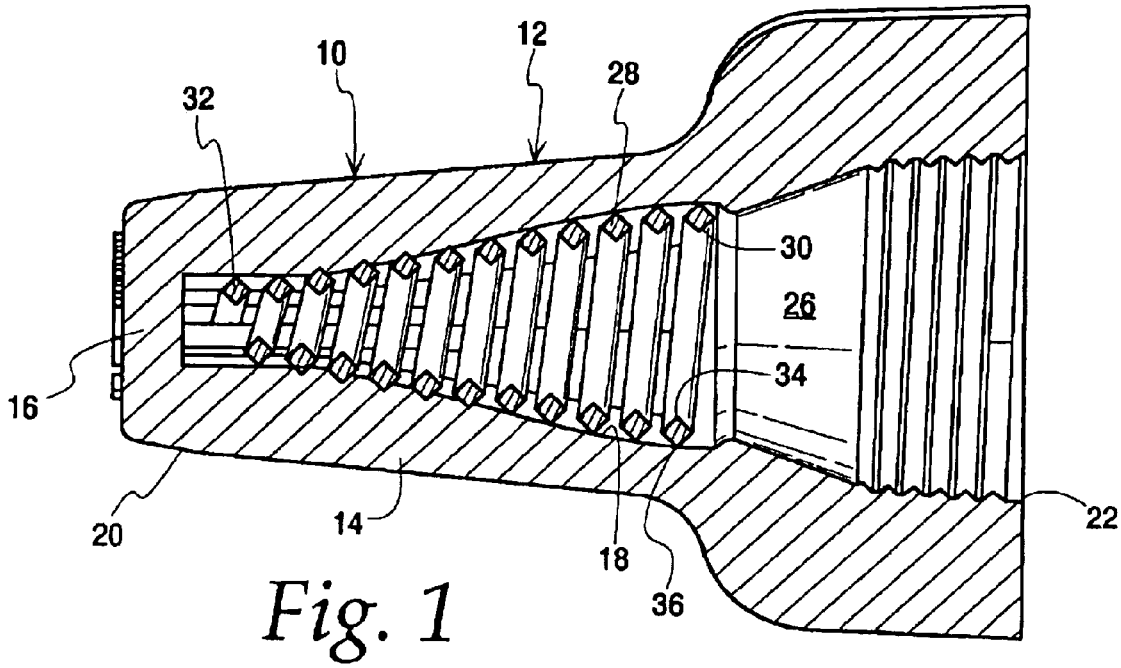
Fig. 1 Prior Art
FIG. 1 is a longitudinal section trough a conventional twist-on wire connector.

A typical twist-on or screw-on wire connector 10 is shown in FIG. 1. It includes an insulating shell 12 having a body wall 14 and an end wall 16. The shell is made of plastic such as polycarbonate. The body wall has an internal surface 18 and an external surface 20. The external surface is generally conical in shape and extends from an opening 22 at the larger end to the integral end wall 16 at the small end. The large end may also have opposing wings 24 to provide leverage when turning the connector onto the stripped ends of electrical wires. The internal surface 18 defines a generally conical shaped cavity 26 which extends from the opening 22 and tapers toward the inner surface of the end wall 16. The internal surface 18 may optionally be threaded at the large end to assist in gripping the insulation of an electrical wire.

A spring 28 is shown in cavity 26. The spring 28 is formed from a plurality of coils or windings of a metal wire and tapers from a large diameter end 30 near the opening 22 to a smaller diameter end 32 near the end wall 16. The taper of the spring usually matches the conical shape of the internal surface 18. Although the spring in FIG. I is in the form of an open helix where the windings do not overlap or abut each other, it can also be in the form of a closed helix where the windings do overlap or abut each other.

The coils of the spring in FIG. 1 have a conventional square cross-sectional shape. The coils are arranged so that one comer 34 of the cross-sectional shape projects into the interior space or cavity defined by the spring itself. This cavity receives the stripped ends of wires to be joined. The opposing comer 36 penetrates the inner surface 18 of the shell to retain the spring in the shell. Although the corners 34, 36 of the square cross section are shown to meet at a sharply defined right angle, this will not always be the case since it is difficult to form wire of this size with truly sharp edges or corners. Generally, the comer has a rounded or radiused surface.

Figure 2:
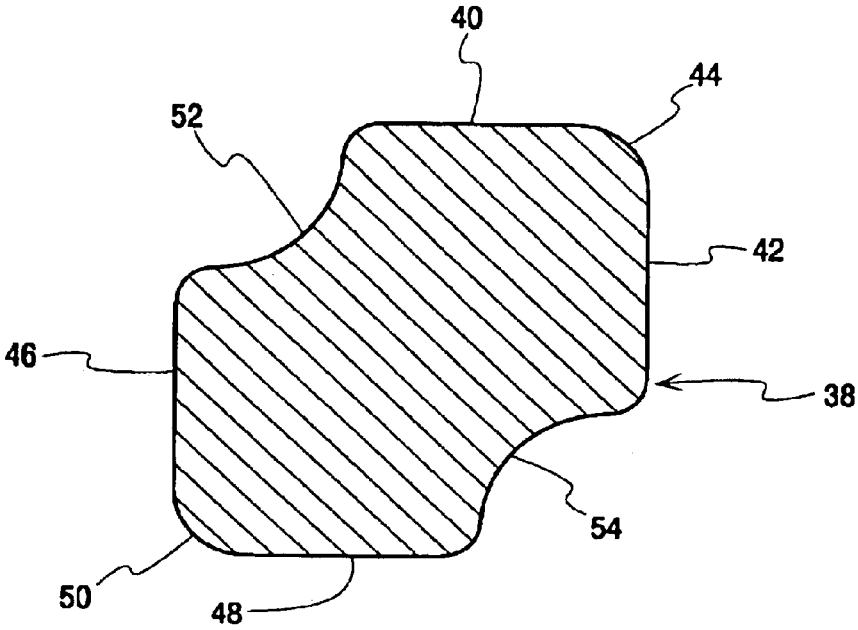
FIG. 2 is a cross-section, on an enlarged scale, through a single coil of a spring according to a first embodiment of the present invention.

FIG. 2 illustrates a first embodiment of the cross-sectional shape of the spring coils according to the present invention. This shape will be referred to herein as a hexagonal shape. As will be seen, not all side of the hexagonal shape have to be straight or planar. The spring coil 38 has first and second surfaces 40, 42 joined with one another at a shell engaging crest 44. There are similar third and fourth surfaces 46, 48 joined with one another at an electrical-wire-engaging crest 50. A fifth surface 52 joins the first and third surfaces while a facing sixth surface 54 joins the second and fourth surfaces. The fifth and sixth surfaces in this embodiment are curved or concave with respect to their adjoining surfaces.

For purposes of illustration and not by way of limitation, suitable dimensions for the cross-sectional shape of FIG. 2 are as follows. The shape defines a generally square footprint. Thus, the distance between the parallel first and fourth surfaces 40 and 48 may be about 0.0262 inches. The distance between the second and third surfaces 42 and 46 is the same 0.0262 inches. The crests 44 and 50 have about a 0.0040 inch radius. The fifth and sixth surfaces have radii of 0.0070 inches and join the crest surfaces at radii of about 0.0020 inches on either side. Again, it should be understood that these dimensions are highly dependent on the overall size of the wire connector. But using these dimensions as an example affords the following comparison. The cross-sectional area of the prior art square footprint with the described dimensions is approximately 0.000673 square inches. The cross-sectional area of the hexagonal cross-section of FIG. 2 is 0.000535 square inches, a 20% reduction over the prior art square shaped cross-sectional area. In this fashion, the amount of metal or other starting material needed to construct the spring insert has been reduced without compromising the holding and gripping ability of the wire connector. The number of engaging surfaces remains the same as before. Similarly, the size of the engaging surface has also not been reduced in order to accomplish the overall reduction in material. If one visualizes the square footprint of the prior art coil by extending the first and third surfaces 40, 46 until they intersect and doing the same with the second and fourth surface 42, 48, it can be seen how the prior art square cross-sectional shape of the spring coils has been modified. Excess material has been eliminated in order to reduce the amount of material used to make the spring and thereby decrease the overall cost of the wire connector. The excess material played no role in gripping and holding the electrical wires or the inner surface of the shell of the wire connector.

Figure 3:
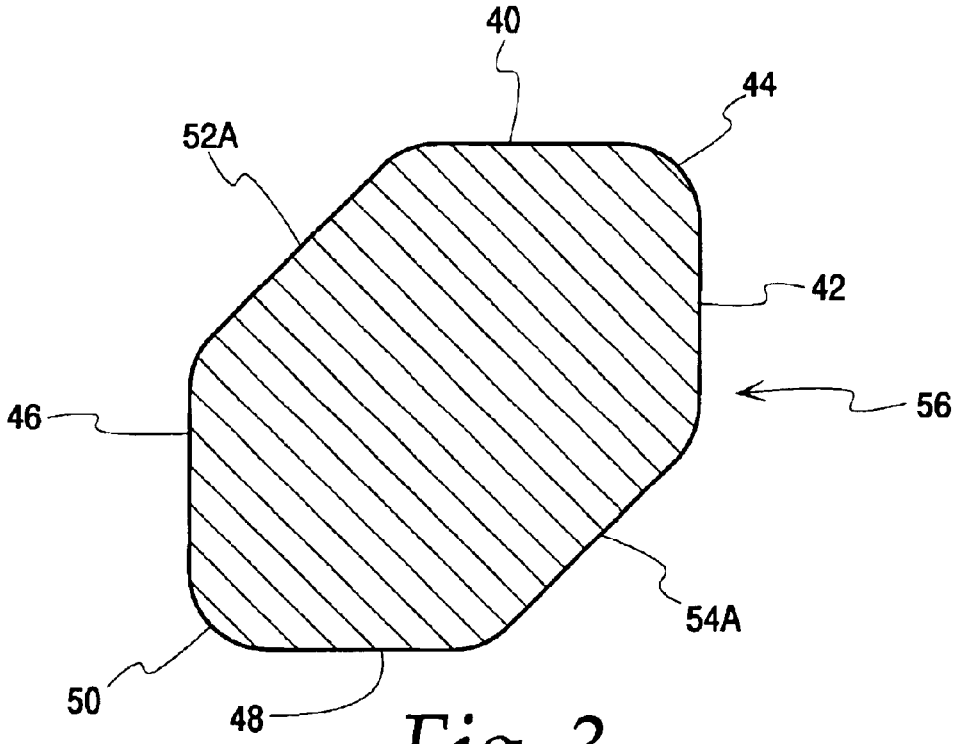
FIG. 3 is a cross-section, on an enlarged scale, through a single coil of a spring according to a second embodiment of the present invention

Another hexagonal embodiment is shown in FIG. 3. The hexagonal shaped cross-section of this coil 56 resembles the previous embodiment shown in FIG. 2 except that the fifth and sixth surfaces sides 52A and 54A are straight instead of concave. Using the dimensions stated above, the cross-sectional area of this embodiment is 0.000557 square inches, a 17% reduction from the prior art square shaped cross-sectional area.

Figure 4:
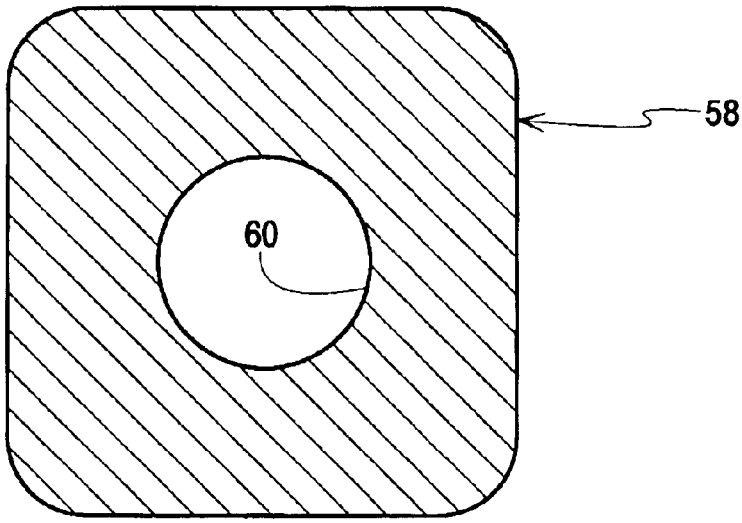
FIG. 4 is a cross-section, on an enlarged scale, through a single coil of a spring according to a third embodiment of the present invention.

A further alternate embodiment is depicted in FIG. 4. The coil 58 of this embodiment has the same cross-sectional shape as the square shaped prior art coil except that a central bore 60 is formed in the coil. As in the other embodiments, excess material represented by the bore is eliminated without compromising the holding and gripping ability of the wire connector. The cross-sectional area of this embodiment is 0.000578 square inches, a 14% reduction over the prior art square cross-sectional area.

Spring inserts embodying the preferred cross-sectional shapes can be made in any method known to those skilled in the art. Extrusion technology provides a preferred method of manufacture. Metal is extruded under pressure through a die opening having the preferred cross-sectional shape.

The spring may be placed in the shell by a variety of methods known to those skilled in the art. One such method involves screwing the spring insert into the shell so that outer crests of the spring bite into the internal surface of the shell. Another such method called heat sinking involves heating the spring to a temperature sufficient to soften or slightly melt a portion of the internal surface of the shell, causing the spring to partially sink into the the shell.

Although various forms of this invention have been shown and described, other embodiments that may be apparent to those skilled in the art are also within the scope of this invention. Accordingly, the scope of the invention is intended to be determined by reference to the appended claims. For example, while the shell body wall is referred to as being conical, other shapes are possible, including cylindrical. Various external features on the body wall are also contemplated.

What is claimed is:

1. A twist-on wire connector for joining the ends of a plurality of electrical wires, comprising:

an insulating shell having a body wall and an end wall, said walls having internal surfaces and defining an internal cavity with an opening at one end for receiving the electrical wires; and a spring mounted in the internal cavity of the shell and engaging the internal surface of the body wall, the spring including a plurality of coils which have a hexagonal cross-section, said hexagonal cross-section having at least four substantially equal sides.

2. The twist-on wire connector of claim 1 further characterized in that the hexagonal cross-section is defined by first and second surfaces joined at a shell-engaging crest, third and fourth surfaces joined at an electrical-wire-engaging crest, a fifth surface joining said first and third surfaces, and a sixth surface joining said second and fourth surfaces.

3. The twist-on wire connector of claim 2 wherein at least one of the fifth and sixth surfaces is generally planar.

4. The twist-on wire connector of claim 2 wherein at least one of the fifth and sixth surfaces is generally concave.

5. The twist-on wire connector of claim 1 wherein the coils form an open helix.

6. A twist-on wire connector for joining the ends of a plurality of electrical wires, comprising:

an insulating shell having a body wall and an end wall, said walls having internal surfaces and defining an internal cavity with an opening at one end for receiving the electrical wires; and a spring mounted in the internal cavity of the shell and engaging the internal surface of the body wall, the spring including a plurality of coils which have a cross-section with a central bore formed therein.

7. The twist-on connector of claim 6 wherein the cross-section of the coils defines a rectangular outer portion.

8. The connector of claim 6 wherein the plurality windings form an open helix.

9. In a twist-on wire connector of the type for joining the ends of a plurality of electrical wires and having an insulating shell having a body wall and an end wall, said walls having internal surfaces and defining an internal cavity with an opening at one end for receiving the electrical wires and a spring mounted in the internal cavity of the shell and engaging the internal surface of the body wall, the improvement comprising a spring including a plurality of coils which have a hexagonal cross-section, said hexagonal cross-section having at least four substantially equal sides.

10. The connector of claim 9 further characterized in that the hexagonal cross-section is defined by first and second surfaces joined at a shell-engaging crest, third and fourth surfaces joined at an electrical-wire-engaging crest, a fifth surface joining said first and third surfaces, and a sixth surface joining said second and fourth surfaces.

11. The connector of claim 10 wherein at least one of the fifth and sixth surfaces is generally planar.

12. The connector of claim 10 wherein at least one of the fifth and sixth surfaces is generally concave.

13. The connector of claim 9 wherein the coils form an open helix.

14. In a twist-on wire connector of the type for joining the ends of a plurality of electrical wires and having an insulating shell having a body wall and an end wall, said walls having internal surfaces and defining an internal cavity with an opening at one end for receiving the electrical wires and a spring mounted in the internal cavity of the shell and engaging the internal surface of the body wall, the improvement comprising a spring including a plurality of coils which have a cross-section with a central bore formed therein.

* * * * *